US010009684B2

(12) United States Patent
Shumard et al.

(10) Patent No.: US 10,009,684 B2
(45) **Date of Patent: *Jun. 26, 2018**

(54) OFFSET CARTRIDGE MICROPHONES

(71) Applicant: Shure Acquisition Holdings, Inc., Niles, IL (US)

(72) Inventors: Brent Robert Shumard, Mount Prospect, IL (US); Gregory H. Canfield, Niles, IL (US); Mark Gilbert, Palatine, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/383,658

(22) Filed: Dec. 19, 2016

(65) Prior Publication Data

US 2017/0230748 A1 Aug. 10, 2017

Related U.S. Application Data

(63) Continuation of application No. 14/701,042, filed on Apr. 30, 2015, now Pat. No. 9,554,207.

(51) Int. Cl.
*H04R 1/32* (2006.01)
*H04R 3/00* (2006.01)
(Continued)

(52) U.S. Cl.
CPC ..... *H04R 1/326* (2013.01); *H04R 3/005* (2013.01); *H04R 3/04* (2013.01); *H04R 19/016* (2013.01);
(Continued)

(58) Field of Classification Search
CPC ..... H04R 1/326; H04R 25/407
USPC ..... 29/594; 379/420.03; 381/71.1, 92, 98, 381/313, 322, 356, 357, 369, 94.7, 304, 381/312, 344, 361, 365
See application file for complete search history.

(56) References Cited

U.S. PATENT DOCUMENTS 2,539,671 A 1/1951 Olson
3,573,399 A 4/1971 Schroeder
(Continued)

OTHER PUBLICATIONS

Sessler, et al. "Directional Transducers," IEEE Transactions on Audio and Electroacoustics, vol. AU-19, No. 1, Mar. 1971, pp. 19-23.

(Continued)

*Primary Examiner* — Gerald Gauthier
(74) *Attorney, Agent, or Firm* — William J. Lenz, Esq.; Neal, Gerber & Eisenberg LLP

(57) ABSTRACT

Offset cartridge microphones are provided that include multiple unidirectional microphone cartridges mounted in an offset geometry. Various desired polar patterns and/or desired steering angles can be formed by processing the audio signals from the multiple cartridges, including a toroidal polar pattern. The offset geometry of the cartridges may include mounting the cartridges so that they are immediately adjacent to one another and so that their center axes are offset from one another. The microphones may have a more consistent on-axis frequency response and may more uniformly form desired polar patterns and/or desired steering angles by reducing the interference and reflections within and between the cartridges.

20 Claims, 5 Drawing Sheets

(51) Int. Cl.
*H04R 3/04* (2006.01)
*H04R 19/01* (2006.01)
*H04R 19/04* (2006.01)

(52) U.S. Cl.
CPC ..... *H04R 19/04* (2013.01); *H04R 2410/03* (2013.01); *H04R 2430/20* (2013.01)

(56) References Cited

U.S. PATENT DOCUMENTS 3,657,490 A * 4/1972 Scheiber ..... H04R 1/222 381/338
3,936,606 A 2/1976 Wanke
4,436,966 A * 3/1984 Botros ..... H04R 1/342 181/157
4,521,908 A 6/1985 Miyaji
4,594,478 A * 6/1986 Gumb ..... H04M 1/03 181/160
4,625,827 A 12/1986 Bartlett
4,658,425 A 4/1987 Julstrom
4,675,906 A 6/1987 Sessler
5,121,426 A * 6/1992 Baumhauer, Jr. ..... H04M 1/20 379/388.02
5,204,907 A 4/1993 Staple
5,289,544 A * 2/1994 Franklin ..... H04R 25/407 381/111
5,297,210 A 3/1994 Julstrom
5,329,593 A * 7/1994 Lazzeroni ..... H04R 1/38 181/158
5,550,925 A 8/1996 Hori
6,137,887 A 10/2000 Anderson
6,173,059 B1 1/2001 Huang et al.
7,106,876 B2 * 9/2006 Santiago ..... H04R 1/406 379/420.03
7,783,063 B2 8/2010 Pocino
7,881,486 B1 * 2/2011 Killion ..... H04R 25/402 381/313
8,259,959 B2 9/2012 Marton
8,345,898 B2 1/2013 Reining
8,355,521 B2 * 1/2013 Larson ..... H04N 7/18 381/355
8,406,436 B2 3/2013 Craven
8,472,639 B2 6/2013 Reining
8,620,650 B2 12/2013 Walters
8,744,101 B1 * 6/2014 Burns ..... H04R 25/407 381/23.1
8,976,977 B2 3/2015 De
9,099,094 B2 8/2015 Burnett
9,196,261 B2 11/2015 Burnett
9,226,088 B2 12/2015 Pandey
9,307,326 B2 4/2016 Elko
9,635,474 B2 * 4/2017 Kuster ..... H04R 25/407
9,674,604 B2 * 6/2017 deRoo ..... H04R 1/326
2002/0048377 A1 * 4/2002 Vaudrey ..... H04R 3/005 381/94.7
2002/0064287 A1 5/2002 Kawamura
2002/0110255 A1 * 8/2002 Killion ..... H04R 1/083 381/356
2002/0159603 A1 10/2002 Hirai
2003/0063768 A1 4/2003 Cornelius
2003/0198359 A1 10/2003 Killion
2004/0076305 A1 4/2004 Santiago
2005/0157897 A1 * 7/2005 Saltykov ..... H04R 25/402 381/322
2006/0222187 A1 * 10/2006 Jarrett ..... H04R 3/002 381/92
2007/0009116 A1 1/2007 Reining
2009/0094817 A1 * 4/2009 Killion ..... H04R 1/38 29/594
2010/0128901 A1 5/2010 Herman
2010/0158268 A1 * 6/2010 Marton ..... H04N 7/142 381/92
2010/0166219 A1 * 7/2010 Marton ..... H04R 3/005 381/98
2010/0189299 A1 7/2010 Grant
2010/0215189 A1 * 8/2010 Marton ..... H04R 1/406 381/92
2011/0096136 A1 4/2011 Liu
2012/0207335 A1 * 8/2012 Spaanderman ..... H04R 1/04 381/361
2013/0028451 A1 * 1/2013 de Roo ..... H04R 1/38 381/312
2013/0039504 A1 2/2013 Pandey
2013/0294616 A1 * 11/2013 Mülder ..... H04R 3/005 381/71.1
2014/0010383 A1 * 1/2014 Mackey ..... H04M 1/03 381/71.1
2014/0050332 A1 * 2/2014 Nielsen ..... H04R 3/005 381/92
2015/0055796 A1 2/2015 Nugent et al.
2015/0104023 A1 4/2015 Bilobrov
2015/0208171 A1 7/2015 Funakoshi
2015/0281834 A1 * 10/2015 Takano ..... H04R 1/08 381/92
2016/0142814 A1 5/2016 Deroo
2016/0323667 A1 * 11/2016 Shumard ..... H04R 3/005
2017/0230748 A1 * 8/2017 Shumard ..... H04R 1/326

OTHER PUBLICATIONS

International Search Report and Written Opinion for PCT/US2016/022773 dated Jun. 10, 2016.
Office Action for Taiwan Patent Application No. 105109900 dated May 5, 2017.

* cited by examiner

OFFSET CARTRIDGE MICROPHONES

CROSS-REFERENCE TO RELATED APPLICATIONS

This application is a continuation of U.S. Non-Provisional patent application Ser. No. 14/701,042, filed on Apr. 30, 2015, the contents of which are fully incorporated herein by reference.

TECHNICAL FIELD

This application generally relates to offset cartridge microphones. In particular, this application relates to microphones including multiple unidirectional microphone cartridges mounted in an offset geometry and having audio signals that can be processed to form a variety of polar patterns.

BACKGROUND

Conferencing environments, such as boardrooms, video conferencing settings, and the like, can involve the use of microphones for capturing sound from audio sources. The audio sources may include human speakers, for example. The captured sound may be disseminated to an audience through loudspeakers in the environment, a telecast, a webcast, telephony, etc. The types of microphones and their placement in a particular environment may depend on the locations of the audio sources, physical space requirements, aesthetics, room layout, and/or other considerations. For example, in some environments, the microphones may be placed on a table or lectern near the audio sources. In other environments, the microphones may be mounted overhead to capture the sound from the entire room, for example. Accordingly, microphones are available in a variety of sizes, form factors, mounting options, and wiring options to suit the needs of particular environments.

The types of microphones that can be used for conferencing may include boundary microphones and button microphones that can be positioned on or in a surface (e.g., a table). Such microphones may include multiple cartridges so that the microphones have multiple independent polar patterns to capture sound from multiple audio sources, such as two cartridges in a single microphone for forming two separate polar patterns to capture sound from speakers on opposite sides of a table. Other such microphones may include multiple cartridges so that various polar patterns can be formed by processing the audio signals from each cartridge. These types of microphones are versatile since they are configurable to form different polar patterns as desired without the need to physically swap cartridges. For these types of microphones, while it would be ideal to co-locate the multiple cartridges within the microphone so that each cartridge detects sounds in the environment at the same instant, however, it is not physically possible. As such, these types of microphones may not uniformly form the desired polar patterns and may not ideally capture sound due to frequency response irregularities, and interference and reflections within and between the cartridges.

Typical polar patterns for microphones and individual microphone cartridges can include omnidirectional, cardioid, subcardioid, supercardioid, hypercardioid, and bidirectional. The polar pattern chosen for a particular microphone or cartridge may be dependent on where the audio source is located, the desire to exclude unwanted noises, and/or other considerations. In conferencing environments, it may be desirable for a microphone to have a toroidal polar pattern that is omnidirectional in the plane of the microphone with a null in the axis perpendicular to that plane. For example, a microphone with a toroidal polar pattern that is positioned on a table detects sound in all directions along the plane of the table but minimizes the detection of sound above the microphone, e.g., towards the ceiling above the table. However, existing microphones with toroidal polar patterns may be physically large, have a high self-noise, require complex processing, and/or have inconsistent polar patterns over a full frequency range, e.g., 100 Hz to 10 kHz.

Accordingly, there is an opportunity for microphones that address these concerns. More particularly, there is an opportunity for microphones including multiple unidirectional microphone cartridges that can reduce interference between the cartridges, more uniformly form desired polar patterns, form a toroidal polar pattern, are relatively small and compact, and have a relatively low self-noise.

SUMMARY

The invention is intended to solve the above-noted problems by providing microphones that are designed to, among other things: (1) reduce the interference and reflections between multiple unidirectional microphone cartridges within a microphone; (2) uniformly form desired polar patterns using the multiple unidirectional microphone cartridges; (3) form a toroidal polar pattern using four unidirectional microphone cartridges in a compact, low noise microphone; and (4) have a more consistent on-axis frequency response.

In an embodiment, a microphone may include a housing and a plurality of unidirectional microphone cartridges mounted within the housing, where each of the unidirectional microphone cartridges has a front-facing diaphragm and a rear port. The unidirectional microphone cartridges are mounted within the housing such that each of the cartridges is immediately adjacent to one another, and a center axis of each of the cartridges is offset from one another.

In another embodiment, a microphone may include a housing having a visual indicator, and four unidirectional microphone cartridges mounted within the housing, where each of the cartridges has a front-facing diaphragm and a rear port. The unidirectional microphone cartridges are immediately adjacent to one another. The microphone may also include a processor in communication with the cartridges that is configured to generate digital audio output signals from the audio signals of the cartridges that correspond to one or more polar patterns. The processor is also configured to activate the visual indicator to indicate the polar pattern.

In a further embodiment, a method of processing a plurality of audio signals from a plurality of unidirectional microphone cartridges mounted within a housing of a microphone using a processor includes receiving a setting denoting desired polar patterns and/or desired steering angles associated with the desired polar patterns; receiving the plurality of audio signals from the unidirectional microphone cartridges; converting the plurality of audio signals into a plurality of digital audio signals; generating one or more digital audio output signals from the plurality of digital audio signals, based on the setting, where the digital audio output signals correspond to the desired polar patterns; and activating a visual indicator on the housing to indicate the desired polar patterns and/or the desired steering angles. The unidirectional microphone cartridges are mounted immediately adjacent to one another within the housing and a center axis of each of the unidirectional microphone cartridges is offset from one another.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
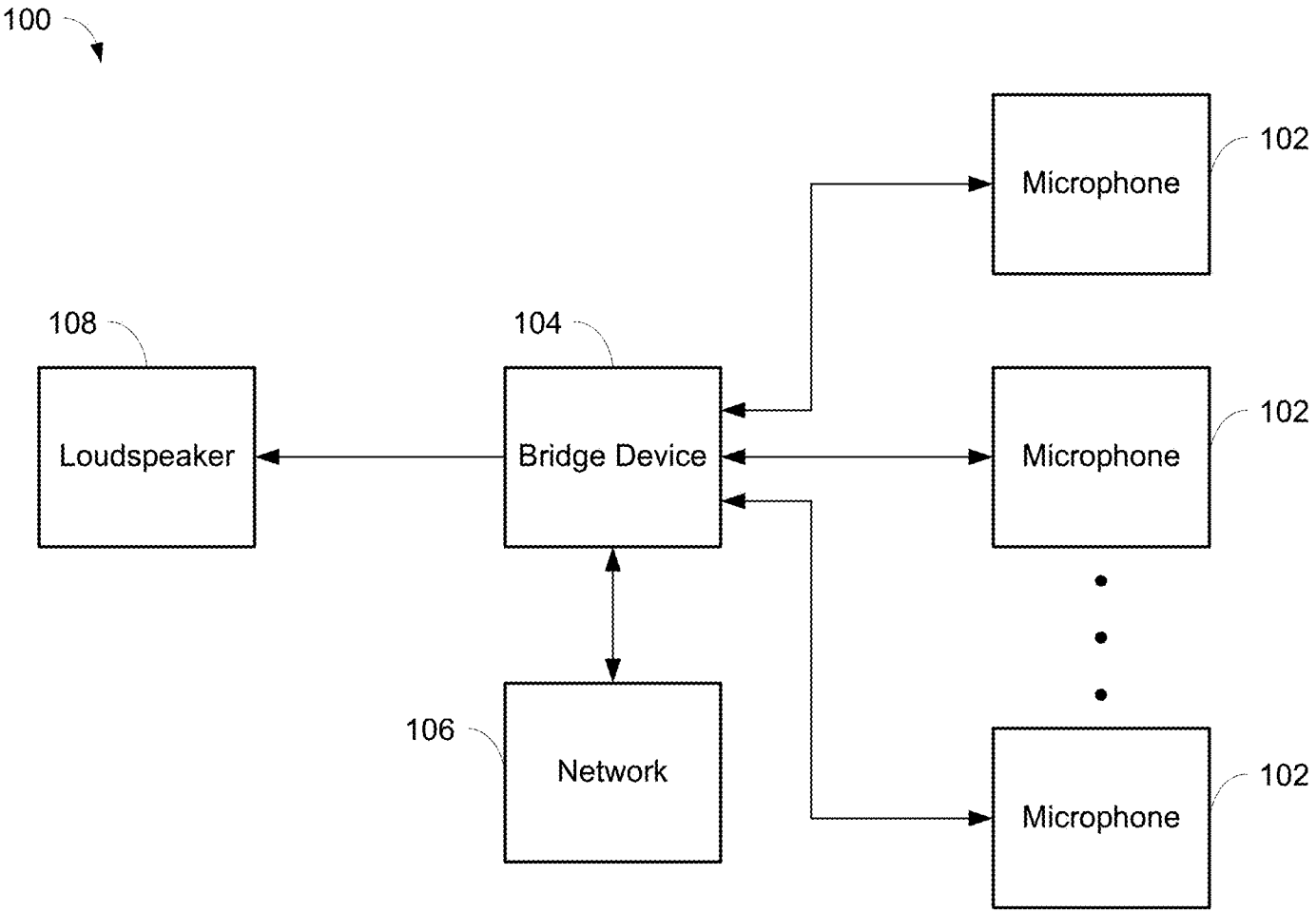
FIG. 1 is a schematic representation of an exemplary conferencing environment including microphones having multiple unidirectional microphone cartridges, in accordance with some embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

The microphones described herein can uniformly form desired polar patterns and/or desired steering angles of the desired polar patterns by using multiple unidirectional microphone cartridges in an offset geometry to reduce the interference and reflections within and between the cartridges. The microphones may also have a more consistent on-axis frequency response. The microphones have the flexibility to form many different types of polar patterns that can be desirable in various conferencing environments, including a toroidal polar pattern. The polar patterns that are steerable by the microphones are first order polar patterns, i.e., defined by a first order periodic function and a scalar adder. A user can therefore configure the microphones as desired to form different polar patterns and/or steering angles associated with the polar patterns, as necessitated by the positioning of human speakers or other audio sources, for example. The microphones are relatively small and can be used in place of multiple microphones that have dedicated polar patterns. Accordingly, the microphones can be aesthetically pleasing while being able to optimally capture sound from speakers and other audio sources in many different situations and environments.

FIG. 1 is a schematic representation of an exemplary conferencing environment 100 in which the microphones described herein may be used. The environment 100 may be in a conference room or boardroom, for example, where microphones 102 are utilized to capture sound from audio sources such as human speakers. Other sounds may be present in the environment which may be undesirable, such as noise from ventilation, other persons, audio/visual equipment, electronic devices, etc. In a typical situation, the audio sources may be seated in chairs at a table, although other configurations and placements of the audio sources are contemplated and possible.

One or more microphones 102 may be placed on a table or lectern, for example, so that the sound from the audio sources can be detected and captured, such as speech spoken by human speakers. The microphones 102 may include multiple unidirectional microphone cartridges in an offset configuration, and be configurable to form multiple polar patterns and/or corresponding steering angles, as described in detail below, so that the sound from the audio sources is optimally detected and captured. The polar patterns that can be formed by the microphones 102 may include omnidirectional, cardioid, subcardioid, supercardioid, hypercardioid, bidirectional, and/or toroidal. The unidirectional microphone cartridges in the microphones 102 may each be an electret condenser microphone cartridge with a cardioid polar pattern and a rear port, in some embodiments. In other embodiments, the unidirectional microphone cartridges may have other polar patterns and/or may be dynamic microphones, ribbon microphones, piezoelectric microphones, and/or other types of microphones. In embodiments, the desired polar patterns and/or desired steering angles formed by the microphones 102 can be configured through software by a user.

Each of the unidirectional microphone cartridges in the microphones 102 may detect sound and convert the sound to an analog audio signal. Components in the microphones 102, such as analog to digital converters, processors, and/or other components, may process the analog audio signals and ultimately generate one or more digital audio output signals. The digital audio output signals may conform to the Dante standard for transmitting audio over Ethernet, in some embodiments, or may conform to another standard. One or more polar patterns may be formed by the processor in the microphones 102 from the audio signals of the unidirectional microphone cartridges, and the processor may generate a digital audio output signal corresponding to each of the polar patterns. In other embodiments, the unidirectional microphone cartridges in the microphones 102 may output analog audio signals so that other components and devices (e.g., processors, mixers, recorders, amplifiers, etc.) external to the microphones 102 may process the analog audio signals from the microphones 102.

In some embodiments, the processor may also mix the audio signals from the unidirectional microphone cartridges and generated a mixed digital audio output signal. For example, the processor may mix the audio signals of the unidirectional microphone cartridges by monitoring whether a particular polar pattern is active. If a particular polar pattern formed by a microphone 102 is active, then the other polar patterns may be muted. In this way, a desired audio mix can be output from the processor such that a targeted audio source is emphasized and the other audio sources are suppressed. Embodiments of audio mixers are disclosed in commonly-assigned patents, U.S. Pat. No. 4,658,425 and U.S. Pat. No. 5,297,210, each of which is incorporated by reference in its entirety.

A bridge device 104 may be in wired or wireless communication with the microphones 102 and receive the digital audio output signals from the microphones 102. The bridge device 104 may also be in wired or wireless communication with a network 106 (e.g., voice over IP network, telephone network, local area network, Internet, etc.) and/or loudspeakers 108. In particular, the bridge device 104 may receive the digital audio output signals from the microphones 102 and convert the digital audio output signals to be transmitted over the network 106, such as to a remote party over telephony. The digital audio output signals from the microphones 102 may also be converted to analog audio signals to be heard over the loudspeakers 108. The bridge device 104 may include controls to adjust parameters of the microphones 102, such as polar pattern, gain, noise suppression, muting, frequency response, etc. In some embodiments, an electronic device may be in communication with the microphones 102 and/or the bridge device 104 to control such parameters. The electronic device may include, for example, a smartphone, tablet computer, laptop computer, desktop computer, etc.

Figure 2:
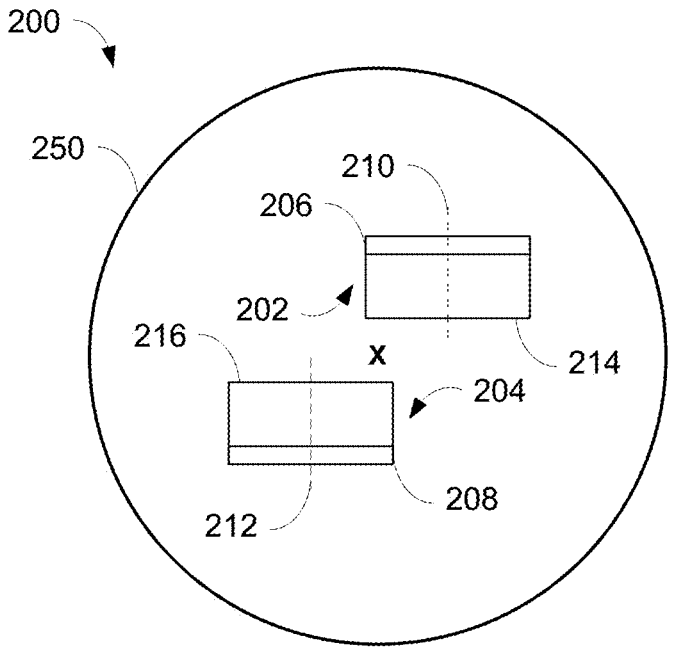
FIG. 2 is a schematic representation of a top view of an interior of a microphone having two unidirectional microphone cartridges in an offset configuration, in accordance with some embodiments.

FIG. 2 is a schematic representation of a top view of the interior of a microphone 200 having two unidirectional microphone cartridges 202, 204 in an offset configuration. The microphone 200 has a housing 250 in which the two unidirectional microphone cartridges 202, 204 are mounted. The housing 250 depicted in FIG. 2 is intended to show a possible envelope for the unidirectional microphone cartridges 202, 204 and is shown as a circular shape, but any suitable shape and/or form factor is contemplated and possible. The housing 250 may include user interface components (not shown), such as switches, buttons, and/or visual indicators, and/or a grille or other cover (not shown) above the unidirectional microphone cartridges 202, 204. The cartridges 202, 204 may be mounted within the housing 250 using any applicable and relevant methods and techniques, as known and utilized in the art.

In some embodiments, the unidirectional microphone cartridges 202, 204 may each be an electret condenser microphone cartridge with a cardioid polar pattern and a rear port 214, 216. The unidirectional microphone cartridges 202, 204 may have diaphragms 206, 208, respectively, that are on the front of each cartridge for detecting sound. Analog audio signals may be output from each of the unidirectional microphone cartridges 202, 204. A processor (not shown) within the microphone 200 and/or external to the microphone 200 may process the audio signals from the unidirectional microphone cartridges 202, 204 to form various polar patterns. The polar patterns may be configurable by a user as desired to optimally capture sound from audio sources, depending on the particular environment.

As seen in FIG. 2, the unidirectional microphone cartridges 202, 204 are mounted within the housing 250 such that the cartridges are adjacent to one another. In particular, at least a portion of the rear port 214 faces at least a portion of the rear port 216, and the diaphragms 206, 208 of the cartridges 202, 204 face outward toward the housing 250. Center axes 210, 212 of the unidirectional microphone cartridges 202, 204, respectively, may be offset from one another such that the unidirectional microphone cartridges 202, 204 are not coaxial. Furthermore, in some embodiments, the center axes 210, 212 of the unidirectional microphone cartridges 202, 204 may also be offset from a center of the housing 250 (denoted by "X" in FIG. 2) so that the unidirectional microphone cartridges 202, 204 are not in line with the center of the microphone 200. The unidirectional microphone cartridges 202, 204 in the microphone 200 are not limited to the configuration as depicted in FIG. 2, and other alignments and/or orientations of the cartridges 202, 204 in the microphone 200 are contemplated and possible.

By positioning the unidirectional microphone cartridges 202, 204 in the microphone 200 as shown in FIG. 2, the interaction effects between the unidirectional microphone cartridges 202, 204 and any additional components (not shown) within the housing 250 can be minimized. For example, reflections within and between the unidirectional microphone cartridges 202, 204 may be mitigated due to the offset geometry of the cartridges. In addition, the polar patterns formed by the unidirectional microphone cartridges 202, 204 may be more uniform and maintained because the cartridges are offset.

Figure 3:
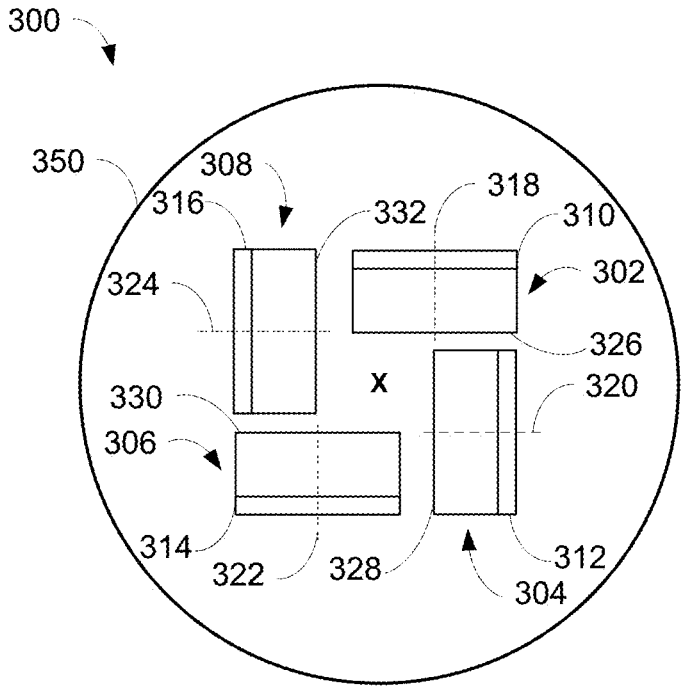
FIG. 3 is a schematic representation of a top view of an interior of a microphone having four unidirectional microphone cartridges in an offset configuration, in accordance with some embodiments.

FIG. 3 is a schematic representation of a top view of the interior of a microphone 300 having four unidirectional microphone cartridges 302, 304, 306, 308 in an offset configuration. The microphone 300 has a housing 350 in which the four unidirectional microphone cartridges 302, 304, 306, 308 are mounted. The housing 350 depicted in FIG. 3 is intended to show a possible envelope for the unidirectional microphone cartridges 302, 304, 306, 308 and is shown as a circular shape, but any suitable shape and/or form factor is contemplated and possible. The housing 350 may include user interface components (not shown), such as switches, buttons, and/or visual indicators, and/or a grille or other cover (not shown) above the unidirectional microphone cartridges 302, 304, 306, 308. The cartridges 302, 304, 306, 308 may be mounted within the housing 350 using any applicable and relevant methods and techniques, as known and utilized in the art.

In some embodiments, the unidirectional microphone cartridges 302, 304, 306, 308 may each be an electret condenser microphone cartridge with a cardioid polar pattern and a rear port 326, 328, 330, 332. The unidirectional microphone cartridges 302, 304, 306, 308 may have diaphragms 310, 312, 314, 316, respectively, that are on the front of each cartridge for detecting sound. Analog audio signals may be output from each of the unidirectional microphone cartridges 302, 304, 306, 308. A processor (not shown) within the microphone 300 and/or external to the microphone 300 may process the audio signals from the unidirectional microphone cartridges 302, 304, 306, 308 to form various polar patterns. The polar patterns may be configurable by a user as desired to optimally capture sound from audio sources, depending on the particular environment.

As seen in FIG. 3, the unidirectional microphone cartridges 302, 304, 306, 308 are mounted within the housing 350 and generally perpendicular to and adjacent to each other. In particular, at least a portion of each of the rear ports 326, 328, 330, 332 is adjacent to and faces at least a portion of a side of a neighboring unidirectional microphone cartridge 302, 304, 306, 308, while the diaphragms 310, 312, 314, 316 face outward towards the housing 350. The cartridge 302 is oriented at 0 degrees and at least a portion of its rear port 326 is adjacent to and facing the side of the cartridge 304; the cartridge 304 is oriented at 90 degrees and at least a portion of its rear port 328 is adjacent to and facing the side of cartridge 306; the cartridge 306 is oriented at 180 degrees and at least a portion of its rear port 330 is adjacent to and facing the side of cartridge 308; and the cartridge 308 is oriented at 270 degrees and at least a portion of its rear port 332 is adjacent to and facing the side of cartridge 302.

Center axes 318, 320, 322, 324 of the unidirectional microphone cartridges 302, 304, 306, 308, respectively, may be offset from one another. Furthermore, in some embodiments, the center axes 318, 320, 322, 324 may be offset from a center of the housing 350 (denoted by "X" in FIG. 3) so that the unidirectional microphone cartridges 302, 304, 306, 308 are not in line with the center of the microphone 300. The unidirectional microphone cartridges 302, 304, 306, 308 in the microphone 300 are not limited to the configuration as depicted in FIG. 3, and other alignments and/or orientations of the cartridges 302, 304, 306, 308 in the microphone 300 are contemplated and possible.

By positioning the unidirectional microphone cartridges 302, 304, 306, 308 in the microphone 300 as shown in FIG. 3, the interaction effects between the unidirectional microphone cartridges 302, 304, 306, 308 and any additional components (not shown) within the housing 350 can be minimized. For example, reflections within and between the unidirectional microphone cartridges 302, 304, 306, 308 may be mitigated due to the offset geometry of the cartridges. In addition, the polar patterns and/or steering patterns formed by the unidirectional microphone cartridges 302, 304, 306, 308 may be more uniform and maintained because the cartridges are offset.

Figure 4:
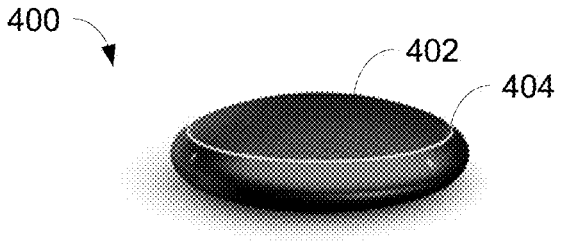
FIG. 4 is a perspective view of an exemplary housing of a microphone having four unidirectional microphone cartridges in an offset configuration, in accordance with some embodiments.

FIG. 4 is a perspective view of an exemplary housing of a microphone 400 having four unidirectional microphone cartridges in an offset configuration, such as the configuration shown in FIG. 3. The microphone 400 may include a grille 402 above the cartridges to protect the cartridges and for reducing unwanted noises, switches and/or buttons (not shown) for control and muting of the microphone 400, and/or a visual indicator 404. The visual indicator 404 may be a multiple color LED ring, for example, that can be activated during usage of the microphone 400, such as when there is an incoming call, when the microphone is active, when the microphone is muted, etc. Some portions or all of the visual indicator 404 may be solid, flashing, and/or shown in different colors, depending on the status and/or usage of the microphone 400, in some embodiments. The visual indicator 404 may also be capable of independent activation in different sections to denote the polar pattern and/or steering angle of the microphone 400. Depending on a setting for a desired polar pattern and/or desired steering angle, a processor or other suitable component in the microphone 400 may activate, e.g., illuminate, the visual indicator 404 in different ways to convey where the polar patterns have been formed. Accordingly, users of the microphone 400 may be informed as to the configuration of the microphone 400 and can position themselves appropriately about the microphone 400 so that their speech is optimally detected and captured.

Figure 5A:
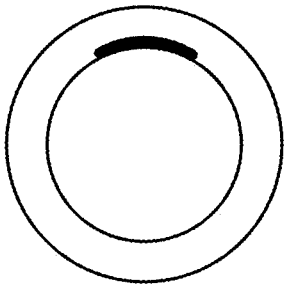
FIGS. 5A-5D are schematic representations of top views of exemplary housings of microphones with different patterns of activated visual indicators, in accordance with some embodiments.
Figure 5B:
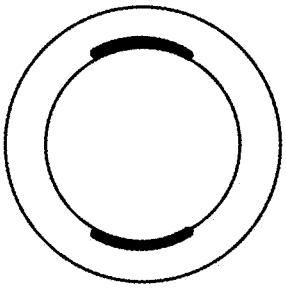
Figure 5C:
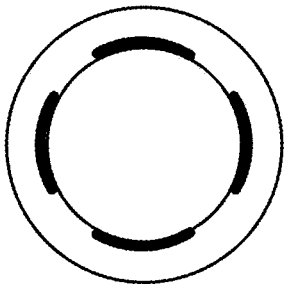
Figure 5D:
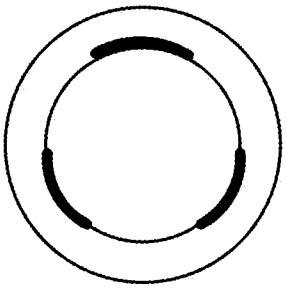

As shown schematically in FIGS. 5A-5D, such a visual indicator may be activated in different ways to reflect the selected polar pattern and/or steering angle of the microphone. For example, a single section of the visual indicator may be activated when a single cardioid polar pattern is formed that is pointed at 0 degrees, as shown in FIG. 5A. In FIG. 5B, when a bidirectional polar pattern is formed that is pointed at 0 and 180 degrees, two separate sections of the visual indicator may be activated, as shown. Four separate sections of the visual indicator may be activated when four cardioid polar patterns are formed that are pointed at 0, 90, 180, and 270 degrees, as shown in FIG. 5C. And in FIG. 5D, when three cardioid polar patterns are formed that are pointed at 0, 120, and 240 degrees, three separate sections of the visual indicator may be activated, as shown. The visual indicators depicted in FIGS. 5A-5D are exemplary, and other patterns of activation of the visual indicator are contemplated and possible, depending on the selected polar pattern and/or steering angle of the microphone.

Figure 6:
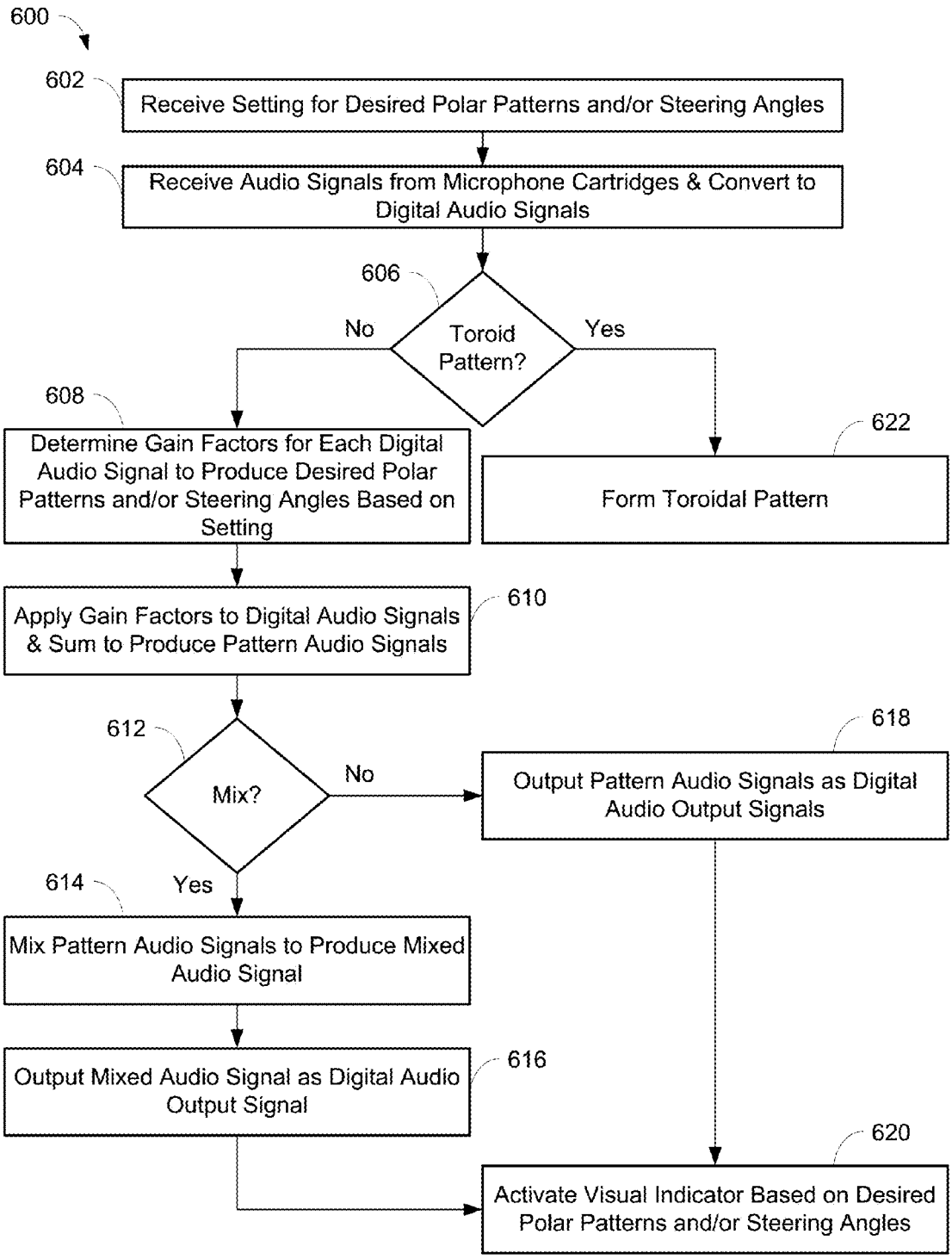
FIG. 6 is a flowchart illustrating operations for processing audio signals from multiple unidirectional microphone cartridges to generate one or more digital audio output signals corresponding to one or more desired polar patterns, in accordance with some embodiments.

An embodiment of a process 600 for processing audio signals from multiple unidirectional microphone cartridges in a microphone to generate digital audio output signals corresponding to desired polar patterns is shown in FIG. 6, in accordance with one or more principles of the invention. The process 600 may be utilized to process audio signals from the multiple unidirectional microphone cartridges in microphones 200, 300 as described above and shown in FIGS. 2 and 3, for example. One or more processors and/or other processing components (e.g., analog to digital converters, encryption chips, etc.) within or external to the microphone may perform any, some, or all of the steps of the process 600. One or more other types of components (e.g., memory, input and/or output devices, transmitters, receivers, buffers, drivers, discrete components, etc.) may also be utilized in conjunction with the processors and/or other processing components to perform any, some, or all of the steps of the process 600.

At step 602, a setting for desired polar patterns and/or desired steering angles of the desired polar patterns may be received. The setting may be received from a bridge device, an electronic device, and/or other control device in communication with the microphone, for example. A user of the microphone may configure the setting as desired to optimally capture sound from audio sources, depending on the particular environment. The desired polar patterns may include, for example, omnidirectional, cardioid, subcardioid, supercardioid, hypercardioid, bidirectional, and/or toroidal. A desired polar pattern may be steered at any desired angle depending on the particular polar pattern, in some embodiments. For example, cardioid, subcardioid, supercardioid, and hypercardioid polar patterns may be steered at different angles, while omnidirectional, bidirectional, and toroidal polar patterns are not steerable. In embodiments, the desired steering angle may be selectable in particular increments, e.g., 15 degrees, for easier configuration by a user. The possible settings for the desired polar patterns and/or desired steering angles may be dependent on the configuration of the multiple unidirectional microphone cartridges in the microphone. For example, a microphone with two unidirectional microphone cartridges, such as the microphone 200 described in FIG. 2, may not be able to steer desired polar patterns or generate a digital audio signal corresponding to a toroidal polar pattern. However, a microphone with four unidirectional microphone cartridges, such as the microphone 300 described in FIG. 3, may be able to generate any desired polar pattern, including a toroidal polar pattern, and steer certain desired polar patterns.

The audio signals from the multiple unidirectional microphone cartridges in the microphone may be processed to form the desired polar patterns and/or desired steering angles. The analog audio signal from each of the unidirectional microphone cartridges in the microphone may be received and converted to a digital audio signal at step 604, such as by an analog to digital converter. At step 606, it can be determined whether the setting received at step 602 is for the desired polar pattern to be a toroidal polar pattern. If the setting is for the desired polar pattern to be a toroidal polar pattern, then the process 600 may continue to step 622 to form the toroidal polar pattern from the audio signals of the unidirectional microphone cartridges. Step 622 is described below in more detail in FIG. 7.

However, if the setting for the desired polar pattern is not for a toroidal polar pattern at step 606, then the process 600 may continue to step 608. At step 608, gain factors for each of the digital audio signals may be determined such that the desired polar patterns and/or desired steering angles are produced, based on the setting received at step 602. The determined gain factors may be applied to the digital audio signals at step 610. The resulting digital audio signals with the gain factors applied may also be summed together at step 610 to produce pattern audio signals. Each of the pattern audio signals produced at step 610 may correspond to each of the desired polar patterns and/or desired steering angles.

At step 612, it can be determined whether the pattern audio signals are to be mixed. Whether the pattern audio signals are mixed may be configurable by a user of the microphone, such as through the setting received at step 602, in some embodiments. If the pattern audio signals are to be mixed, then the process 600 continues to step 614 where the pattern audio signals are mixed to produce a mixed audio signal. The mixed audio signal may be output as a digital audio output signal at step 616. However, if the pattern audio signals are not to be mixed at step 612, then the process 600 continues to step 618 to output the pattern audio signals produced at step 610 as digital audio output signals. The digital audio output signal(s) output at steps 616 and 618 may conform to the Dante standard for transmitting audio over Ethernet, for example. In some embodiments, a visual indicator on the microphone may be activated at step 620 to indicate the desired polar patterns and/or desired steering angles, based on the setting received at step 602. Different patterns of activating the visual indicator are discussed and shown in FIGS. 5A-5D.

As an example of the process 600, if the setting is for the desired polar pattern and desired steering angle to be a single cardioid polar pattern pointed at 0 degrees, then the analog audio signals from each of the unidirectional microphone cartridges in the microphone may be used to generate a single digital audio output signal corresponding to that single cardioid polar pattern. In addition, a single section of the visual indicator on the microphone may be activated at 0 degrees, similar to what is depicted in FIG. 5A. As another example, if the setting is for the desired polar patterns and desired steering angles to be four cardioid polar patterns pointed at 0, 90, 180, and 270 degrees, then the analog audio signals from each of the unidirectional microphone cartridges in the microphone may be used to generate four digital audio output signals (or a single digital audio output signal, if mixing is desired). The four digital audio output signals may respectively correspond to the four cardioid polar patterns. Four sections of the visual indicator on the microphone may be activated at 0, 90, 180, and 270 degrees, similar to what is depicted in FIG. 5C. As a further example, if the setting is for the desired polar pattern to be a bidirectional polar pattern, then the analog audio signals from each of the unidirectional microphone cartridges in the microphone may be used to generate a digital audio output signal corresponding to the bidirectional polar pattern. Two sections of the visual indicator on the microphone may be activated at 0 and 180 degrees, similar to what is depicted in FIG. 5B.

Figure 7:
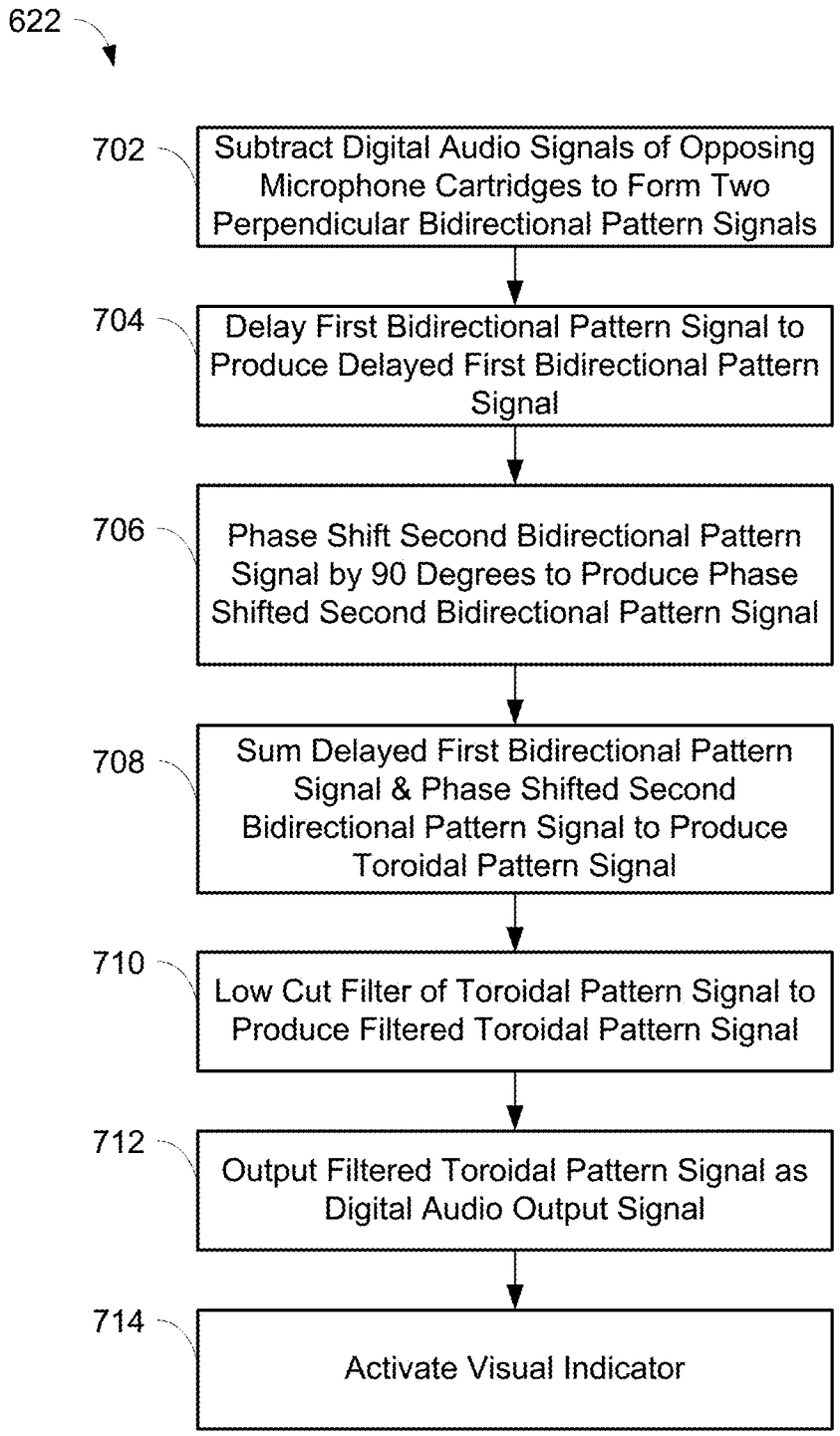
FIG. 7 is a flowchart illustrating operations for processing audio signals from multiple unidirectional microphone cartridges to generate a digital audio output signal corresponding to a toroidal polar pattern, in accordance with some embodiments.

FIG. 7 describes further details of an embodiment of step 622 for forming a toroidal polar pattern from the audio signals of the unidirectional microphone cartridges. In this embodiment, the microphone may have four unidirectional microphone cartridges in an offset configuration, similar to the microphone 300 shown in FIG. 3. At step 702, the digital audio signals of two of the unidirectional microphone cartridges are respectively subtracted from the digital audio signals of the two opposing unidirectional microphone cartridges to produce two bidirectional pattern signals. The two bidirectional pattern signals correspond to two bidirectional polar patterns that are formed perpendicular to each other. For example, in the configuration shown in FIG. 3, the digital audio signal of the unidirectional microphone cartridge positioned at 180 degrees (i.e., cartridge 306) is subtracted from the digital audio signal of the opposing unidirectional microphone cartridge positioned at 0 degrees (i.e., cartridge 302) to produce a first bidirectional pattern signal. The digital audio signal of the unidirectional microphone cartridge positioned at 270 degrees (i.e., cartridge 308) is subtracted from the digital audio signal of the opposing unidirectional microphone cartridge positioned at 90 degrees (i.e., cartridge 304) to produce a second bidirectional pattern signal.

The first bidirectional pattern signal may be delayed at step 704 to produce a delayed first bidirectional pattern signal. The first bidirectional pattern signal is delayed at step 704 to align the first bidirectional pattern signal in time with a phase shifted second bidirectional pattern signal that is produced at step 706. At step 706, the second bidirectional pattern signal is phase shifted by 90 degrees to produce the phase shifted second bidirectional pattern signal. A Hilbert transform (or a finite impulse response approximation of a Hilbert transform) of the second bidirectional pattern signal may be used to cause the 90 degree phase shift, for example. Accordingly, the first bidirectional pattern signal is non-phase shifted and goes straight through (with a delay) and the second bidirectional pattern signal is phase shifted by 90 degrees.

The delayed first bidirectional pattern signal and the phase shifted second bidirectional pattern signal may be summed at step 708 to produce a toroidal pattern signal. The toroidal pattern signal may be low cut filtered at step 710 to produce a filtered toroidal pattern signal to ensure that the frequency responses of the first and second bidirectional polar patterns do not vary significantly from one another. The filtered toroidal pattern signal may be output as the digital output audio signal at step 712. The digital audio output signal output at step 712 may conform to the Dante standard for transmitting audio over Ethernet, for example. In some embodiments, a visual indicator on the microphone may be activated at step 714 to indicate the toroidal polar pattern, based on the setting received at step 602.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. A method of processing respective audio signals from first, second, third, and fourth unidirectional microphone cartridges into an audio output signal corresponding to a toroidal polar pattern, using a processor, the method comprising:

receiving an audio signal at the processor from each of the first, second, third, and fourth unidirectional microphone cartridges, wherein the first, second, third, and fourth unidirectional microphone cartridges are immediately adjacent to one another;

producing first and second bidirectional pattern signals, using the processor, based on the audio signals of the first, second, third, and fourth unidirectional microphone cartridges;

delaying the first bidirectional pattern signal to produce a delayed first bidirectional pattern signal, using the processor;

phase shifting the second bidirectional pattern signal by 90 degrees to produce a phase shifted second bidirectional pattern signal, using the processor;

summing the delayed first bidirectional pattern signal and the phase shifted second bidirectional pattern signal to produce a toroidal pattern signal, using the processor; and outputting the toroidal pattern signal as the audio output signal corresponding to the toroidal polar pattern, using the processor.

2. The method of claim 1, wherein producing the first and second bidirectional pattern signals comprises:

subtracting the audio signal of the third unidirectional microphone cartridge from the audio signal of the first unidirectional microphone cartridge to produce the first bidirectional pattern signal, using the processor; and subtracting the audio signal of the fourth unidirectional microphone cartridge from the audio signal of the second unidirectional microphone cartridge to produce the second bidirectional pattern signal, using the processor.

3. The method of claim 1:

further comprising low cut filtering the toroidal pattern signal to produce a filtered toroidal pattern signal, using the processor;

wherein outputting the toroidal pattern signal comprises outputting the filtered toroidal pattern signal as the audio output signal corresponding to the toroidal polar pattern, using the processor.

4. The method of claim 1, wherein a center axis of each of the first, second, third, and fourth unidirectional microphone cartridges is offset from one another.

5. The method of claim 1, wherein the first, second, third, and fourth unidirectional microphone cartridges are disposed within a housing of a microphone.

6. The method of claim 5, further comprising activating a visual indicator on the housing to indicate the toroidal polar pattern, using the processor.

7. The method of claim 5, wherein a center axis of each of the first, second, third, and fourth unidirectional microphone cartridges is offset from a center of the housing.

8. The method of claim 1, wherein:

a rear port of the first unidirectional microphone cartridge is immediately adjacent to and faces at least a portion of a side of the second unidirectional microphone cartridge;

a rear port of the second unidirectional microphone cartridge is immediately adjacent to and faces at least a portion of a side of the third unidirectional microphone cartridge;

a rear port of the third unidirectional microphone cartridge is immediately adjacent to and faces at least a portion of a side of the fourth unidirectional microphone cartridge; and a rear port of the fourth unidirectional microphone cartridge is immediately adjacent to and faces at least a portion of a side of the first unidirectional microphone cartridge.

9. The method of claim 1, wherein a center axis of each of the first, second, third, and fourth unidirectional microphone cartridges is generally perpendicular to one another.

10. The method of claim 1, wherein each of the first, second, third, and fourth unidirectional microphone cartridges comprises an electret condenser microphone cartridge with a cardioid polar pattern.

11. A microphone, comprising:

first, second, third, and fourth unidirectional microphone cartridges, each of the first, second, third, and fourth unidirectional microphone cartridges comprising a front-facing diaphragm and a rear port, the diaphragm configured to detect sound from an audio source and convert the sound to an audio signal; and a processor in communication with the first, second, third, and fourth unidirectional microphone cartridges, the processor configured to generate an audio output signal from the audio signal of each of the first, second, third, and fourth unidirectional microphone cartridges by;

delaying a first bidirectional pattern signal to produce a delayed first bidirectional pattern signal, the first bidirectional pattern signal produced based on the audio signals of the first, second, third, and fourth microphone cartridges;

phase shifting a second bidirectional pattern signal by 90 degrees to produce a phase shifted second bidirectional pattern signal, the second bidirectional pattern signal produced based on the audio signals of the first, second, third, and fourth microphone cartridges; and summing the delayed first bidirectional pattern signal and the phase shifted second bidirectional pattern signal to produce the audio output signal;

wherein:

each of the first, second, third, and fourth unidirectional microphone cartridges is immediately adjacent to one another; and the audio output signal corresponds to a toroidal polar pattern.

12. The microphone of claim 11, wherein a center axis of each of the first, second, third, and fourth unidirectional microphone cartridges is offset from one another.

13. The microphone of claim 11, wherein:

the rear port of the first unidirectional microphone cartridge is immediately adjacent to and faces at least a portion of a side of the second unidirectional microphone cartridge;

the rear port of the second unidirectional microphone cartridge is immediately adjacent to and faces at least a portion of a side of the third unidirectional microphone cartridge;

the rear port of the third unidirectional microphone cartridge is immediately adjacent to and faces at least a portion of a side of the fourth unidirectional microphone cartridge; and the rear port of the fourth unidirectional microphone cartridge is immediately adjacent to and faces at least a portion of a side of the first unidirectional microphone cartridge.

14. The microphone of claim 11, wherein a center axis of each of the first, second, third, and fourth unidirectional microphone cartridges is generally perpendicular to one another.

15. The microphone of claim 11, wherein each of the first, second, third, and fourth unidirectional microphone cartridges comprises an electret condenser microphone cartridge with a cardioid polar pattern.

16. The microphone of claim 11:

further comprising a housing;

wherein the first, second, third, and fourth unidirectional microphone cartridges are disposed within the housing.

17. The microphone of claim 16, wherein a center axis of each of the first, second, third, and fourth unidirectional microphone cartridges is offset from a center of the housing.

18. The microphone of claim 16, wherein the processor is further configured to activate a visual indication on the housing to denote the toroidal polar pattern.

19. The microphone of claim 11, wherein at least a portion of the rear port of each of the first, second, third, and fourth unidirectional microphone cartridges is immediately adjacent to one another.

20. The microphone of claim 11, wherein the processor is further configured to:

receive a setting denoting the toroidal polar pattern; and generate the audio output signal by generate the audio output signal corresponding to the toroidal pattern, based on the setting.

* * * * *